United States Patent [19]

Haile

[11] Patent Number: 4,716,413

[45] Date of Patent: Dec. 29, 1987

[54] DRUNK DRIVER DETECTION SYSTEM

[76] Inventor: Ernest Haile, 30 Cadwalder Ter., Trenton, N.J. 08618

[21] Appl. No.: 826,440

[22] Filed: Feb. 5, 1986

[51] Int. Cl.[4] ..... G08G 1/01

[52] U.S. Cl. ..... 340/933; 180/272; 200/86 A; 340/52 R; 340/576

[58] Field of Search ..... 340/573, 576, 933, 940, 340/908, 52 R, 52 D, 61, 114 R, 114 B; 116/39, 58 R, 28 R, 28 A; 180/272, 274, 271; 404/6, 9–15; 200/86 A, 86 R, 61.36

[56] References Cited

U.S. PATENT DOCUMENTS

| | | | |
|---|---|---|---|
| 1,172,084 | 2/1916 | Warner . | |
| 1,836,655 | 6/1927 | Dunford | 200/86 A |
| 1,999,661 | 4/1935 | Nagashev . | |
| 2,371,909 | 3/1945 | Naerbo . | |
| 2,580,155 | 12/1951 | Brannen . | |
| 2,885,508 | 5/1959 | Wilcox | 340/940 |
| 3,474,400 | 10/1969 | Auer, Jr. et al. . | |
| 3,509,527 | 10/1969 | Oakes et al. | 340/940 |
| 3,516,056 | 6/1970 | Matthews . | |
| 3,794,966 | 2/1974 | Platzman . | |
| 3,835,449 | 10/1974 | Viracola | 340/933 |
| 3,911,390 | 10/1975 | Myers | 340/940 |
| 3,950,725 | 4/1976 | Kitajima . | |
| 4,091,370 | 5/1978 | Swanda . | |
| 4,250,434 | 2/1981 | Valansot | 200/86 A |
| 4,515,499 | 5/1985 | Furiate | 404/6 |

FOREIGN PATENT DOCUMENTS

| | | | |
|---|---|---|---|
| 2260856 | 9/1975 | France | 200/86 A |
| 2036140 | 6/1980 | United Kingdom | 404/15 |

*Primary Examiner*—James L. Rowland
*Assistant Examiner*—Brent A. Swarthout
*Attorney, Agent, or Firm*—Sperry, Zoda & Kane

[57] ABSTRACT

A system for quick detection of driver impairment as evidenced by the driver's inability to keep a vehicle on an assigned course, utilizes parallel strips defining a relatively narrow lane through which the driver is to operate the vehicle. The strips, and their associated equipment, are readily portable, and are thus adapted to be set up by police officers at any location desired, in a minimum amount of time, thereby permitting spot checks with little or no advance warning to motorists passing the check point. The strips are hollow, and contain pressure chambers, the volume of which is reduced whenever a vehicle tire crosses or rides along one of the strips. Reduction of the pressure chamber volume is adapted to actuate switches, strategically located at predetermined intervals along the length of the respective strips. The switches in turn close circuits, when so activated, to recording devices, radar equipmet, or any other checking apparatus favored by the authorities.

3 Claims, 13 Drawing Figures

DRUNK DRIVER DETECTION SYSTEM

BACKGROUND OF THE INVENTION

1. Field Of The Invention

The present invention relates generally to the category of equipment adapted to be set up on an open highway, for the purpose of checking the possible impairment, due to alcohol, of motorists. In a more specific sense, the equipment is of the type utilizing a pair of portable strips between which a driving lane is defined, with said strips being adapted to be quickly attachable to the highway surface, in positions such as to require that the motorists pass therebetween, and do so in a manner that will quickly indicate whether or not they are capable of operating a vehicle safely, in the sense of maintaining their vehicles along a proper course.

2. Description Of The Prior Art

Heretofore, equipment for checking vehicle operators to determine whether they are driving under the influence of alcohol has been used successfully by police officers. However, in some instances this involves direct stoppage of the vehicles, including the requirement of the police officers making a visual check, or using particular types of equipment, that will enable police officers to reach some type of evaluation, even a preliminary evaluation, of the driver's ability to operate the vehiole.

This type of equipment is time-consuming, in that the vehicle must be stopped, and the driver must be questioned or otherwise tested.

At the present time, the authorities, and indeed the population in general, are becoming more and more concerned about the problem of motorists operating their vehicles on city streets or highways while under the influence of alcohol. Many states have established extremely strong laws for penalizing drunk drivers, and this has had a desirable effect. However, at the same time many drunk drivers are undoubtedly escaping undetected, due to the fact that the police officers do not have sufficient time to check as many vehicles as they would like, utilizing test equipment and methods presently known.

This problem of checking drunk drivers in sufficient numbers over a given period of time, has posed a problem that desirably should be solved, for the purpose of detection of and possible criminal and civil action against even more drunk drivers than are presently being found and prosecuted.

The main object of the present invention is to remedy this deficiency in the prior art devices, by providing a system for detecting driver impairment, especially impairment due to the excessive consumption of alcoholic beverages, which system will permit swift detection of a very large number of drivers in a minimum amount of time, at locations where spot checks are to be made, without the irritation and loss of time attendant upon the stoppage of drivers who are in full possession of their faculties, and who are not impaired in any way so far as their driving ability is concerned.

SUMMARY OF THE INVENTION

Summarized briefly, the present invention involves the provision, basically, of a pair of elongated strips, each of which is composed of a plurality of readily separable sections. The provision of the strips in sections of manageable length permits them to be swiftly taken up from a highway surface, stored in a truck, and removed for relocation at another point where spot checks are to be made for driver impairment.

In accordance with the invention, each strip is preferably formed of rubber or other flexible, durable material, in such a fashion as to define within each strip a pressure chamber that extends the length thereof. The chamber is defined, in part, by a top wall that is specifically designed to be depressed whenever a vehicle tire rides over it or along the length of the strip. Depression of the top wall of the pressure chamber of any section of the strip in turn activates a switch provided at an end of the particular section, whereby the switch may close a circuit to an alarm, radar device, printing device, timer, or any other device adapted to inform police officers standing by. In this way, any vehicle that does not negotiate the driving lane defined between the strips can be stopped immediately, while other vehicles that remain within the lane from end to end thereof can be permitted to proceed on their way without inconvenience, and without loss of time so far as the police officers are concerned.

In accordance with the invention, the strips may be so designed as to be set up at any desired transverse distance from each other, whereby to permit the lane to be made as narrow as is permitted by enabling legislation, or possibly within the discretion of the police officers operating the spot check for driver impairment. The invention further includes provisions for initially providing an offset or compoundly, gently curved section, requiring operation of the steering wheel in such a manner as to require that the driver be in full possession of his faculties, as he enters the inspection lane.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figures 1, 2, 3:
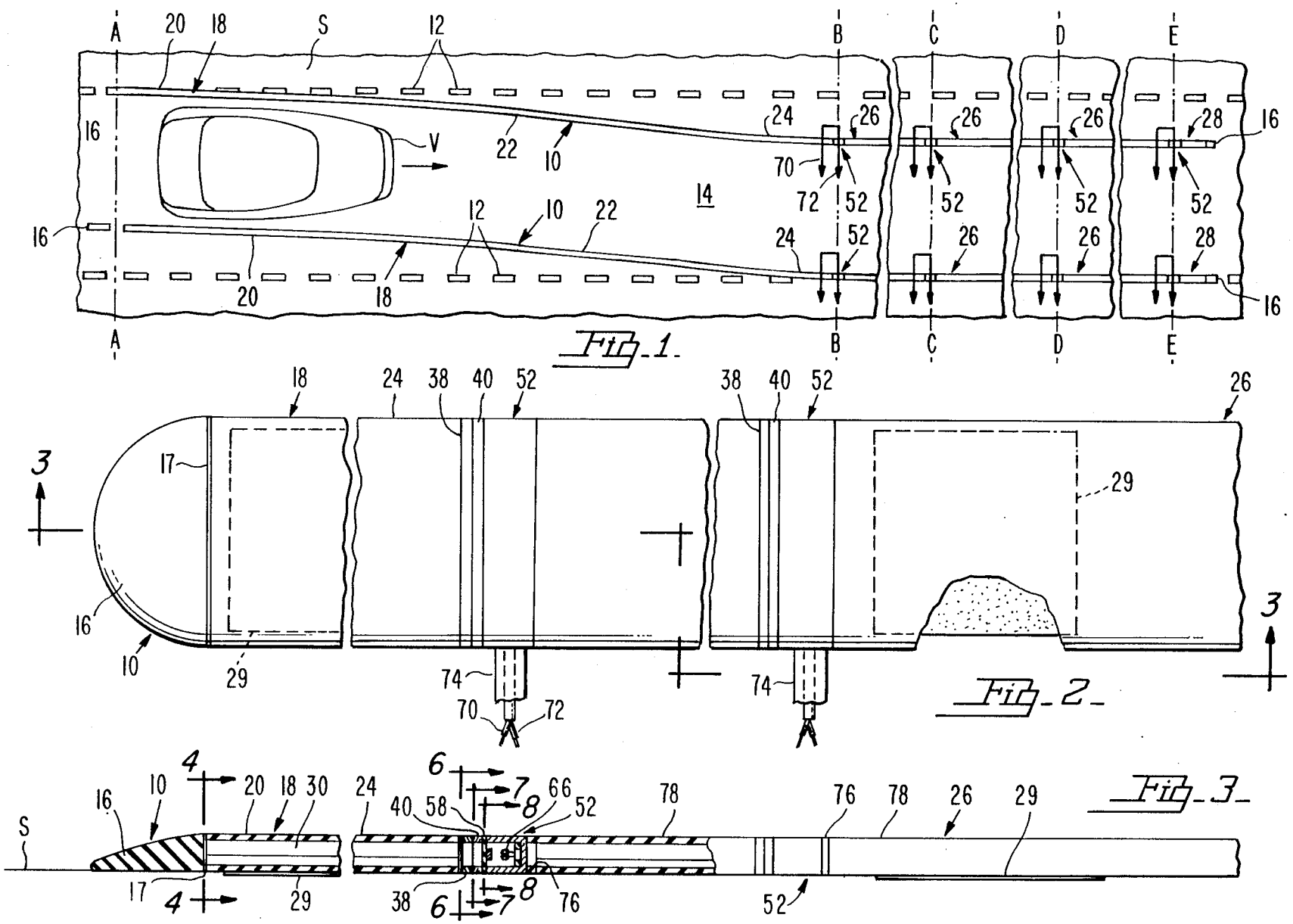
FIG. 1 is a fragmentary top plan view of a highway surface, illustrating a vehicle entering a relatively narrow traffic lane utilizing the equipment comprising the present invention.
FIG. 2 is a greatly enlarged, fragmentary top plan view of the entrance end of one of the strips.
FIG. 3 is a longitudinal section substantially on line 3—3 of FIG. 2, on the same scale as FIG. 2.

Referring to the drawing in detail, the present invention comprises a pair of parallel, like, inspection lane boundary strips 10 adapted to be temporarily attached to a highway surface S having conventional driving lane markings 12, so that the boundary strips 10 define an inspection or check lane of reduced width, which must be negotiated by a vehicle V.

At the entrance end of the driver check lane 14, the strips have end pieces 16 which, as seen from FIGS. 2 and 3, are of solid rubber, and are generally semi-circular when viewed in top plan, with a top surface (see FIG. 3) that slopes gently upwardly in the sense of the direction in which the vehicle V is traveling as it enters the check lane 14.

End piece 16 is provided with a vertical, straight transverse surface secured by adhesive 17 to one end of the entrance section 18 of each strip 10. At this point, it may be noted that the description of one of the strips, so far as its basic structure is concerned, applies to the other, identically formed strip.

Each strip 10 includes, as noted above, an entrance section 18 which may be of any desired length, but which in a typical embodiment might be on the order of about 100 feet long. Each of the additional sections of the strip, which sections will be described hereinafter, would be of a corresponding length, so that a particular strip 10, when the inspection system is set up, might be comprised of a total of four sections, each of which would be of the same length as the other sections (as for example, 100 feet in a typical, preferred embodiment).

Considering the entrance section 18 of a strip 10, it includes an entrance or first portion 20 which is straight, and which may extend perhaps one-fourth of the total length of the strip, said portion merging into an intermediate portion 22, which is compoundly curved, along a gently curving line, and which merges into the exit or second end section 24 of the strip, said exit section also being straight, but very possibly being somewhat shorter than the straight entrance portion 20. By reason of this arrangement, the exit portion 24 is offset transversely of the highway from the entrance portion 20, for purposes which will be made fully apparent hereinafter during the discussion of the operation and use of the system.

Each strip 10, in addition to the first or entrance section 18, includes a selected number of straight, identically formed intermediate sections generally designated 26, and then terminates in an exit or second end section 28. Section 28 is straight from end to end, but differs from the straight intermediate sections 26 in the sense that it is terminated by an end piece 16 similar to that previously described herein.

Section 18, as previously noted herein, includes an elongated main body that includes the straight entry portion 20, the compoundly curved intermediate portion 22, and the straight exit portion 24.

It may be noted that terms "entry" or "entrance" are used to designate areas of the boundary strips or the traffic lane 14 defined thereby, that are initially passed by the vehicle V as it moves through the course laid out by the police officers through the use of the boundary strips. And, the term "exit" is similarly used to indicate the portions of the strips and the check lane that are passed by the vehicle as it leaves a particular section and enters the next section of the course traversed by the vehicle. It may also be noted at this point that the strips are quickly positioned upon the highway surface S, and caused to remain in their assigned positions, through the provision of squares or rectangular pieces of double-sided adhesive sheets 29 (see FIGS. 2 and 3). These are applied to the flat undersides of the various sections, at any locations along the length thereof desired by the police officers, and when so applied permit the strips to be temporarily but effectively secured to the surface S in such a way as to assure that they will not be dislocated by vehicles traversing the course laid out by the police officers.

In the illustrated example, and referring to FIG. 1, it may be noted that the police officers have here set up the strips in such a way that one of the strips 10, this being the upper strip in the showing of the invention in FIG. 1, has the entrance portion of its entry section 18 in alignment with a conventional lane marking 12. The other, parallel strip 10 has its corresponding portion 20 spaced inwardly from the second conventional lane marking 12, thereby providing a check lane 14 of a width that is substantially less than the width of the ordinary driving lane defined between the painted, permanent lane markings 12. The width of the check lane 14 can vary, as previously noted herein. However, typically the police officers would set it up so that the strips 10 are spaced apart a distance such that perhaps 12 to 16 inches would be left between the vehicle tires at one side of the vehicle V, and the adjacent inspection line boundary strip 10, for a vehicle of conventional, medium size. Again, this is entirely within the discretion of the police officers, and the width of the check lane 14 might also be established by legislation in the particular state or municipality in which the spot check for drunk drivers is to be made. A typical width for the check lane 14 might be 9 feet, at the present time.

Should industry trends result in smaller and smaller vehicles, the width of the lane 14 might very possibly be reduced.

In any event, in the illustrated example, one strip 10 (the left-hand strip as it would be viewed by the driver of vehicle V) begins on the left-hand permanent lane marking 12, while the right-hand strip is spaced inwardly from the right-hand lane marking 12. Then, the first or entrance sections 18 are gently, compoundly curved, first to the right and then to the left as seen by the driver, until the right-hand strip 10 becomes aligned with the right-hand lane marking 12, for the duration of the inspection system, while the left-hand strip 10 now becomes transversely inwardly spaced from the left-hand lane marking 12. At the exit end of the inspection lane area defined between the first strip sections 18, the several intermediate sections 26, and the exit sections 28 are all aligned, and extend straight to the end of the test lane 14, with the right-hand strips sections 26, 28 being aligned with the right-hand permanent lane markings 12 of the highway.

The particular construction of each strip is shown to best advantage in FIGS. 2–9. As seen from FIG. 3, at the beginning end of the strip, shown as the left-hand end in FIG. 3, there is the solid end block 16, which closes one end of pressure chamber 30 of the strip section 18. The pressure chamber 30 is continuous, within section 18 throughout the length of the integrally joined entrance portion 20, intermediate portion 22, and exit end portion 24.

Figure 4:
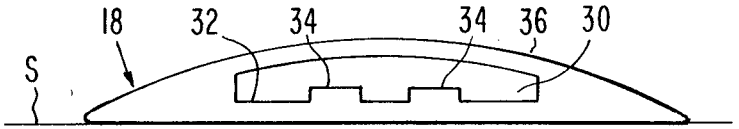
FIG. 4 is a transverse section, on a scale enlarged above that of FIGS. 2 and 3, taken substantially on line 4—4 of FIG. 3.

Throughout this continuous length of the main body of the section 18, pressure chamber 30 has the cross-sectional shape shown to best advantage in FIG. 4. As will be noted from FIG. 4, the strip section is transversely curved, so that the tire T of a vehicle can ride upwardly thereon without dislodging the strip laterally. Pressure chamber 30 has a flat bottom wall 32, on which transversely spaced, parallel, continuous, low, wide spacer ribs 34 are formed. Spaced upwardly, under normal conditions, from ribs 34 is the top wall 36, which is transversely upwardly bulged as shown in FIG. 4, for the full length of the strip.

Figure 5:
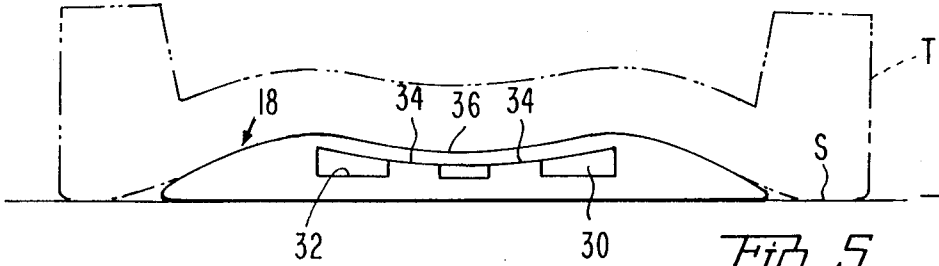
FIG. 5 is another sectional view taken on line 4—4 of FIG. 3, in which the top wall of the strip has been depressed by a vehicle tire, the tire being shown fragmentarily and in dash-dotted outline.

If the operator of the vehicle V is unable to maintain the proper spacing from the respective strips 10, and rides up on one or the other of the strips, or crosses over a strip, the tire T of the vehicle will depress the top wall 36, which is flexible, though normally possessed of sufficient resiliency as to maintain the form thereof shown in FIG. 4. The top wall 36 is forced downwardly by the tire T, as shown in FIG. 5, into engagement with the spacer ribs 34. The ribs 34 prevent the top wall 36 from completely closing the pressure chamber 30, but as will be noted from FIG. 5, the depression of the top wall does reduce the total volume of the chamber 30 during the time that the tire T is exerting pressure thereagainst. This, as will be made apparent hereinafter, causes a diaphragm to be deflected at the front (exit) end of the strip section.

Figure 6:
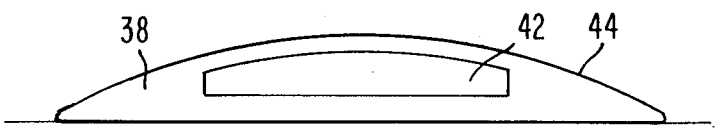
FIG. 6 is a transverse sectional view on line 6—6 of FIG. 3, showing a magnet attached to an end of one of the strip sections to facilitate connection of a switch assembly thereto.
Figure 9:
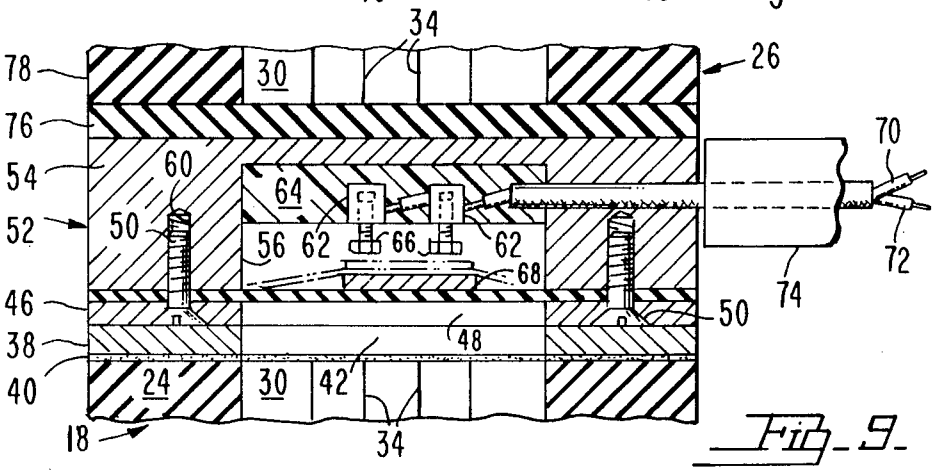
FIG. 9 is a horizontal sectional view, substantially on line 9—9 of FIG. 8, on the same scale as FIG. 8.

Referring now to FIGS. 6 and 9, at the front end of the strip section 18, a relatively thin permanent magnet 38 is adhesively secured as at 40. Magnet 38 (FIG. 6) has a chamber or internal cavity 42 similar to the cavity or chamber 30, except for the fact that the magnet does not have the spacer ribs 34. Since the magnet is formed of a rigid, strong material, there is no need for the ribs 34, the top wall 44 being sufficiently thick and strong as to prevent its depression when the tire rolls upon or over the strip section.

Figure 7:
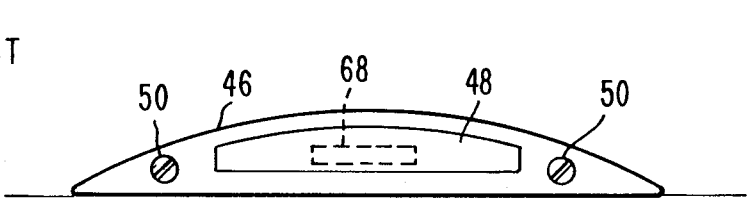
FIG. 7 is a transverse sectional view on line 7—7 of FIG. 3, showing a second magnet attached to the switch assembly and adapted to be attracted to the magnet shown in FIG. 6.

Magnet 38 is adapted to be brought into abutting relation to a mating, magnetically attractable element 46, which could be, for example, a thin piece of steel or other ferrous material adapted to be attracted to the permanent magnet 38. As shown in FIG. 7, element 46 is shaped, in cross-section, similarly to magnet 38, having a hollow center 48. At opposite sides of the cavity or chamber 48 of magnet 46, there are smooth-walled openings adapted to receive screws 50.

The screws are utilized for the purpose of connecting the element 46 to a switch generally designated 52. Switch 52 is formed as shown to particular advantage in FIGS. 8 and 9, having a housing 54 of steel or other rigid material having the requisite strength and durability to withstand the elements and the pressures exerted thereon as vehicles traverse the lane and ride over or upon the boundary strips.

Formed in the housing 54 (see FIG. 9) is a deep recess 56, opening toward the pressure chamber 30 and the center openings 42, 48 of the respective magnets. As seen from FIG. 8, the recess 56, when viewed in cross-section, is shaped similarly to the openings 42, 48 of the magnets. However, communication between the recess and openings 42 and 48 and the pressure chamber communicating therewith is prevented by a diaphragm or membrane 58 interposed between magnet 46 and switch housing 54, and having openings registering with the screw-receiving openings of the magnet 46. Screws 50 extend through the registering openings of the magnet and diaphragm, and are threadedly engaged in threaded recesses 60 formed in the housing 54 at opposite sides of the recess 56.

Figure 11:
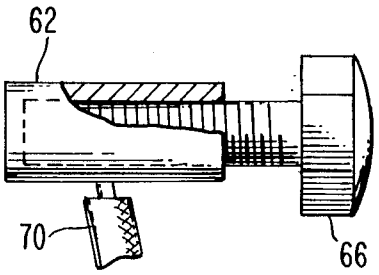
FIG. 11 is a greatly enlarged side elevational view, partly in section, of one of the switch terminals.

Within recess 56, there is provided a pair of spaced sleeves 62 which, as shown in FIG. 11, are closed at one end, and are formed with threaded recesses opening upon their other ends. Sleeves 62 are positioned within recess 56 in spaced relation to the steel material of the housing, and are permanently embedded, in the illustrated embodiment, in an electrically insulative plastic 64. The sleeves, in manufacture of the device, can be potted within the plastic, that is, the potting material 64 can be poured into the recess, around the sleeves, and when cured will permanently mount the sleeves in spaced relation, and in positions in which they are electrically insulated from each other and from the material of the switch housing. The sleeves are of brass or other electrically conductive metal which will afford resistance to corrosion and the elements, and receive hex head screws 66 having rounded surfaces. The screws may also be of brass or other non-corrosive, electrically conductive material, similar to that of the sleeves, and are normally in spaced relation to a conductive bridge element 68 (see FIG. 9) that is adhesively secured or otherwise attached to the central portion of the diaphragm 58. The screws 66 can be adjusted inwardly or outwardly, to provide adjustments as to the spacing normally existing between the bridge and the heads of the screws when the diaphragm is in its normal, unflexed condition.

Soldered, welded, or otherwise permanently secured to the sleeves 62, before the potting is applied, are wires or conductors 70, 72. These extend outwardly (see FIG. 8) through a transverse channel or recess formed in the underside of the switch housing and designated 73.

Exteriorly of the boundary strip, the wires 70, 72 are encased within a suitable insulative covering, and in order to properly position the wires and hold them down against the surface S, there are provided tapes 74 (FIGS. 2, 8 and 9), said tapes having pressure-sensitive adhesive on their undersides, so as to permit them to adhere to the highway pavement.

It will thus be seen that end section 18 comprises, basically, an elongated strip section having a pressure chamber 30, said pressure chamber being closed at one end by the end piece 16 and at its other end by the diaphragm 58. The top wall of this chamber is resiliently flexible, so as to be capable of being forced downwardly by a vehicle tire. As a result, the volume of this chamber can be reduced temporarily, and when so reduced, will cause pressure to be exerted against the diaphragm, with the result that the diaphragm will be deflected to shift the bridge 68 into electrical bridging relationship to the hex head screws 66.

It is also seen that the end strip section 18 has, at one end, a permanent magnet 38 permanently secured thereto by the adhesive 40.

The switch housing is formed separately from the section 18, and is not permanently connected to the boundary strip. Rather, the housing is preassembled with the diaphragm 58 and the magnet or magnetically attractable element 46, though the provision of the screws 50. The diaphragm serves not only the function of being deflectable to bring the bridge 68 into electrical contact with the screws 66, but also serves to provide a sealing gasket covering and extending about the recess 66 as to prevent water or foreign substances from entering the recess 56.

With the switch 52 preassembled in this manner, it is merely necessary, when the system is being set up at a selected location, to bring the magnetic element 46 into face-to-face contact with the element 38. By strong magnetic attraction, the switch 52 is immediately connected to the strip section 18, so as to cause said section 18 to be closed at the switch end, in a relationship such that any reduction in the volume of the pressure chamber 30 of the strip section 18 will be translated into a deflection of the diaphragm to close the attached switch 52.

Considering the construction of the next adjacent strip section, designated as one of the sections 26 and the assembled relationship of the several components illustrated in FIG. 1, it may be noted that as shown in FIG. 9, it has a flat end piece 76 of rubber or the like, adhesively secured to an elongated strip section 78 having a pressure chamber 30 and spacer ribs 34 similar to those of the section 20, 22, 24.

The strip section 78 would be of a length corresponding to that of the first section, that is, approximately 100 feet in a preferred embodiment. At its exit end, it would be provided with a permanently attached magnet 38, so as to permit connection of another switch 52 as shown to best advantage in FIGS. 1–3. Thus, each section, at its exit end, is provided with its own switch, adapted to be closed responsive to a temporary reduction in the volume of the pressure chamber 30 thereof.

Figure 10:
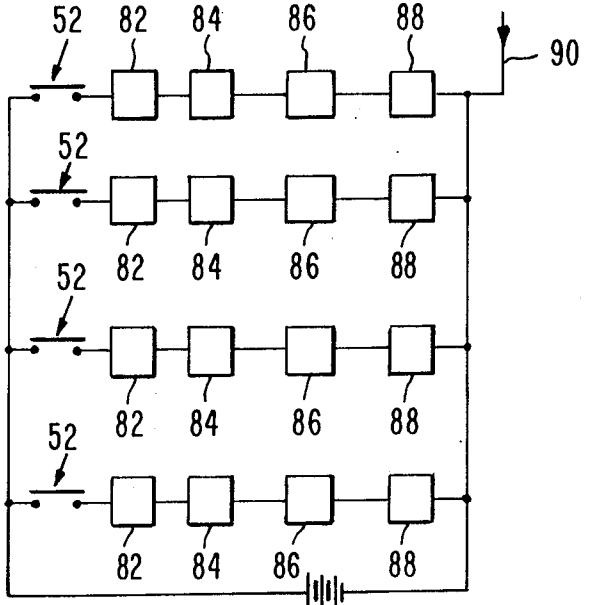
FIG. 10 is a schematic view showing how the system comprising the present invention may be connected to various recording, alarm, printing, or radio transmission devices adapted to alert the officers who are standing by, to the fact that a vehicle has failed to negotiate the assigned course satisfactorily.
Figure 8:
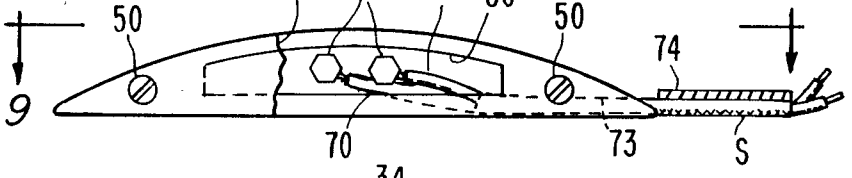
FIG. 8 is a transverse sectional view substantially on line 8—8 of FIG. 3, looking into the switch housing, a portion of a diaphragm used for operating the switch being broken away.

Referring to FIG. 10, it is there shown schematically that when the system is laid out at a selected location along a highway, the several switches 52 thereof are connectable to a source of electricity 80, such as a battery, and each switch is also in circuit with any of various conventional signaling and/or recording devices selected by the users of the detection system. Thus, purely by way of example, there are schematically illustrated in FIG. 10, in circuit with each switch, a device for playing a recording to be transmitted so that it can be picked up by radio in a patrol car standing by, said device being designated 82; a time printing device, such as a time clock, designated 84 adapted to print the year, month, date, hour and second when a circuit therethrough is closed; a radar speed determining device 86 adapted to provide a print-out of the speed of the vehicle while the circuit is closed; and a printing device 88 adapted to print a particular, selected word identifying the strip section that has been crossed by a vehicle. A transmitter 90 in circuit with all the switches is adapted to transmit information as brought out above, to a nearby patrol car, not shown.

At this point, it may be noted that so far as the present invention is concerned, it is regarded as comprising the components particularly illustrated in FIGS. 1–9, 11, and 12. The showing of FIG. 10 is merely illustrative of possible ways in which the police may want to use the electrical signals produced by closing of the switches 52. Obviously, the police can use those signals in any desired way, and could even, in a simplified arrangement, simply utilize the switches to close circuits to an audible alarm device such as a bell or gong, and/or a flashing light. The showing of FIG. 10 represents a more complex arrangement, but for the purposes of the present invention, it is only important to note that the switches are in circuit with a source of electrical power, so that when any switch is closed it can actuate one or more electrical alarm devices or the like, either through direct connections by wire conductors to said devices, or alternatively, by activation of a radio transmitter to send a signal to a patrol car or other location where the police may be posted.

Figure 12:
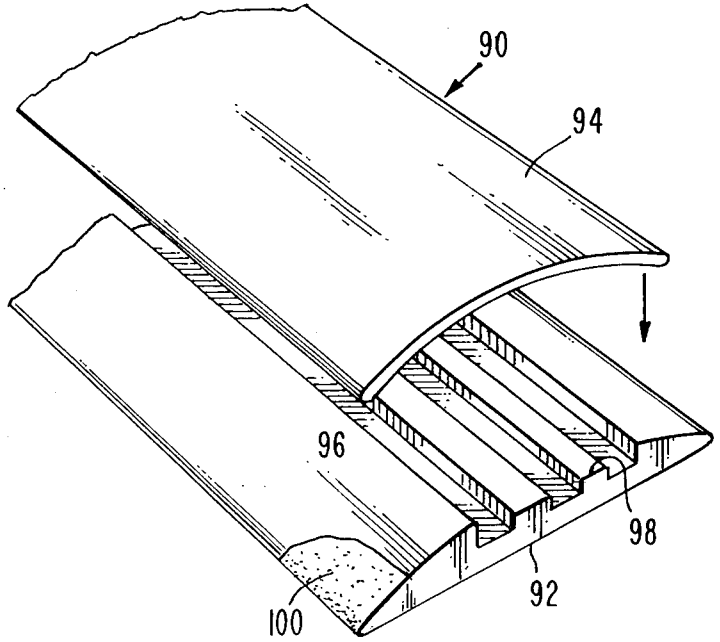
FIG. 12 is a fragmentary exploded perspective view of a modified strip section.
Figure 13:
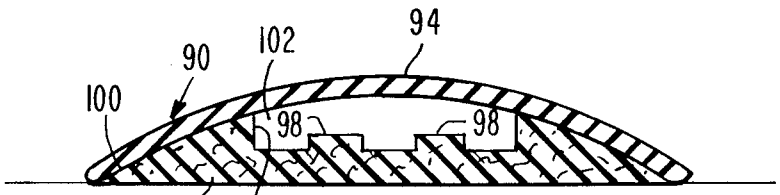
FIG. 13 is a transverse sectional view of the modified strip section shown in FIG. 12.

FIGS. 12 and 13 show a modified arrangement, in which each strip section, instead of being formed as an integral member by an extrusion process or the like, would be formed instead in two pieces. In this form of the invention the strip section 90 includes a base piece 92 of molded rubber or the like, and overlying the base there would be provided a transversely curved cover or tread element 94. The base 92 has an upwardly opening, longitudinal recess 96, on the flat bottom surface of which are transversely spaced, parallel, longitudinally extending spacer ribs 98 are formed. Ribs 98 are spaced from the tread element 94, when the base and tread element are assembled in the manner shown in FIG. 13. Adhesive 100 is utilized, in a preferred embodiment, to bond the tread element to the base piece.

The advantage of an arrangement such as shown in FIGS. 12 and 13 lies in the adaptability for constructing the base piece and the cover element of materials having different structural and functional characteristics. Thus, the base piece should be very strong, and though flexible to the extent that it can be rolled up when the system is to be transported, would preferably be possessed only of a relatively low characteristic of yieldability when subjected to pressure. Indeed, it would be desirable in molding or otherwise forming the base piece 92, to include fibers, threads, or other strengthening material therein, so as to increase its strength and durability and resistance to the elements and hard wear.

The tread element 94, on the other hand, would be thinner and more flexible, so as to permit it to resiliently yield under the pressure of the vehicle tire T when the vehicle is driven erratically and rides up upon or crosses over the boundary strip. What is mainly important, in all forms of the invention, is that the boundary strips be rugged, adapted to remain in place when in use, and capable of use over long periods of time and under many types of adverse conditions without appreciable deterioration. And, it is equally of importance that whenever the boundary strips are to be taken up and transported, they should be capable of being rolled up upon spools or the like, not shown, in coils of perhaps four feet diameter.

OPERATION

In use of the invention, as indicated above the police would transport the boundary strips, with each strip section being coiled for convenience in transporting the same. At the selected location, the boundary strips are uncoiled, and are laid out upon the highway pavement in the manner shown, by way of typical example, in FIG. 1. It is there shown that the entrance end strip sections 18 are first uncoiled and laid out, in parallel relation, to define an entrance test lane 14 that would be perhaps nine feet in width. The hold-down elements 29, in the form of double-sided adhesive sheets, are used to adhere the sections 18 to the pavement in their proper positions.

At the exit end of lane 14, switches 52 are secured to the respective sections 18, by magnetic attraction, in the manner described previously herein. Then, straight sections 26 are applied in end-to-end relation with each other and with the sections 18. These sections are also transversely spaced apart the same distance as the sections 18, in the present instance approximately nine feet. As each section 26 is put down, its end piece 76 is abutted against the switch housing of the next preceded section. At the exit end of each strip section 26, it is provided with its own switch 52 closable responsive to a temporary reduction in the volume of the pressure chamber of that section. Additional sections 26 are put down in whatever number desired (in the present instance three intermediate straight sections 26 are used), after which an exit strip section 28 is put down. Section 28 merely guides the vehicles out of the test lane, and has no associated switch 52. Rather, at the exit end of the entire system, the sections 28 are closed by end pieces 16 similar to those used at the starting end of the system.

The switches 52 are all in circuit with a source of electric power, and are individually connected to any suitable alarm device (see devices 82, 84, 86, 88 for example).

Let it be assumed now that a vehicle V enters the lane 14. The test boundary strips are very close to the opposite sides of the vehicle, so the vehicle must be operated with care as it proceeds through the test lane. Initially, the driver of the vehicle is confronted with the compoundly curved entrance section, and must negotiate this section without riding up upon one or the other of the boundary strips. By appropriate signs or other warnings given the driver before he or she enters the test lane, the driver is informed of the speed at which he must operate his vehicle through the test system.

It may now be noted from FIG. 1 that the full length of the test lane is divided into four sections, A-B; B-C; C-D; and D-E. Each of these sections, in a typical arrangement, would be approximately 100 feet in length. Section A-B is the entrance section, having the compound curvature that must be negotiated by the vehicle. The remaining sections are straight, with no further curves. At the exit end of section A-B, there are transversely aligned switches 52, one at each side of the exit from this section. Considering the boundary strips of this section in the sense that the driver would see them, switch 52 at the left of the exit is closed whenever a vehicle tire rides across or upon the left hand strip. Similarly, the right hand switch 52 at the exit of section A-B is closed whenever the vehicle rides up or over the right-hand boundary strip of the section.

When the vehicle traverses section B-C, the left and right hand switches 52 at the exit end of this section are actuated whenever the vehicle crosses over or rides along the left or right hand boundary strips of this section.

Similarly, there are left and right hand switches at the exit end of section C-D, responsive to pressures exerted against the boundary strips at the left or right of the lane, within the confines of this section of the system. And, finally, left and right hand switches 52 are provided at the exit end of section D-E, actuated in the same manner. Each and every switch is adapted to actuate one or more recording and/or alarm devices, connected in series or in parallel with the appropriate switch by the police to meet their particular needs.

Section A-B might be considered as section "1". When the electrical circuit is closed by the switches 52 at the exit end of this section, the police may utilize a recorded voice to speak the word "1" into a transmitter so that it can be picked up by radio in a nearby patrol car. The recorded voice would then continue to speak the word "1" at the rate of once per second for as long as the circuit is closed.

Also, closure of the switches of this section can activate a time printing device, such as a time clock, to print the year, month, date, hour and second at the rate of once per second for as long as the circuit is closed.

Further, closure of the electrical circuit of this section may activate a radar speed determining device, that makes prints of the speed at the rate of one per second for as long as the circuit is closed.

And, closure of the electrical circuit of section "1" may also be used to activate a printing device to cause the word "1" to be printed at the rate of once per second for as long as the circuit is closed. Thus, if a driver runs over section "1" on Mar. 1, 1986, the print-out might be as follows: 86 (for the year); 3 (for the month); 1 (date); 23 (hour); 31 (minute); 30 (second); 1 (section); 35 (miles per hour).

All the remaining sections, eight being shown in the illustrated example, would be similarly comprised.

As indicated above, the police may utilize the information in any way desired. In a very basic, completely simplified set-up, each switch 52 may be connected to no more than an electric lamp and/or an alarm bell, since the invention does not comprise the construction of the alarm devices, but rather, the structure shown in FIGS. 1–9 and 11–13 for the readily portable drunk driver test lanes and associated switches.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A readily portable apparatus adapted to be laid out upon a road surface as an aid in checking motorists for possible dirver impairment, comprising:

(a) a pair of parallel, identically formed inspection lane boundary strips, each strip having a portion formed with a distinct curvature in the direction of the length of the strip and a fluid pressure chamber having closures at both ends thereof sealing the chamber against leakage, said chamber having a resiliently flexible top wall adapted to be depressed by a vehicle wheel so as to temporarily reduce the volumetric capacity of the chamber and thereby transmit an increased fluid pressure longitudinally of said curved portion to the ends of the chamber, the closure at one end of the chamber being of a material unyielding in the presence of said increased pressure, the closure at the other end of the chamber being formed as a resiliently flexible diaphragm stretched across said other end and adapted to deflect under said increased pressure longitudinally outwardly of the chamber;

(b) means for temporarily locating said strips upon a road surface in a transversely spaced relation selected to form therebetween a traffic lane that has a distinctly curved area defined by the curved portions of the strips whereby when a vehicle rides up upon at least one of the boundary strips the curved traffic lane has not been successfully negotiated, and the presence of an impaired driver is indicated;

(c) first electrical contact means mounted on the diaphragm exteriorly of said chamber so as to shift therewith longitudinally outwardly of the chamber;

(d) second contact means mounted in the strip exteriorly of said chamber in the path of deflection of the first contact means and engageable by the first contact means on deflection of the diaphragm; and (e) an alarm circuit actuatable responsive to said engagement of the contact means, to generate a signal indicating the failure of the vehicle to negotiate the traffic lane successfully.

2. Apparatus as in claim 1 wherein the strip comprises a plurality of sections each of which has a pressure chamber sealed off from the chambers of the other sections and has at one end of its pressure chamber a diaphragm and first and second contact means individual to said chamber, whereby to generate signals at locations identifying particular areas of the traffic lane that have not been negotiated successfully.

3. Apparatus as in claim 1 wherein the curved portion of each strip has a curvature occurring between straight portions of the strip and curved along lines that will form a curved area of the traffic lane between straight but transversely offset straight areas thereof.

* * * * *